US005274534A

United States Patent [19]

Armstrong

[11] Patent Number: 5,274,534

[45] Date of Patent: Dec. 28, 1993

[54] LIGHTING SYSTEM FOR PLAYING FIELDS

[76] Inventor: J. Delvin Armstrong, 2224 137th Pl. SE., Bellevue, Wash. 98005

[21] Appl. No.: 865,099

[22] Filed: Apr. 8, 1992

[51] Int. Cl.[5] ..... F21V 21/10

[52] U.S. Cl. ..... 362/249; 362/231; 362/431

[58] Field of Search ..... 362/230, 231, 249, 252, 362/263, 368, 370, 410, 414, 431, 382; 273/411, 29

[56] References Cited

U.S. PATENT DOCUMENTS

| | | | |
|---|---|---|---|
| 1,983,734 | 12/1934 | Cahill | 362/252 |
| 3,660,650 | 5/1972 | Van Dusen, Jr. | 362/252 |
| 3,995,250 | 11/1976 | Ferree | 362/431 |
| 4,141,056 | 2/1979 | Neely | 362/431 |
| 4,202,543 | 5/1980 | Collins | 273/411 |
| 4,228,487 | 10/1980 | Hesse et al. | 362/368 |
| 4,450,507 | 5/1984 | Gordin | 362/431 |
| 4,570,209 | 2/1986 | Wittlin | 362/231 |

FOREIGN PATENT DOCUMENTS

| | | | |
|---|---|---|---|
| 1429867 | 3/1976 | United Kingdom | 362/431 |

OTHER PUBLICATIONS

Uddeholm Steel Corporation, Upddeholm High Mounted Lighting, 6 pages.

*Primary Examiner*—Richard R. Cole
*Assistant Examiner*—Y. Quach
*Attorney, Agent, or Firm*—Jensen & Puntigam

[57] ABSTRACT

The illumination system includes a plurality of illumination structures (10), the illumination structures being arranged around the periphery of the playing field. Each illumination structure (10) includes a mounting pole (12) and a plurality of luminaires which are individually mounted by mounting arms from the pole. The luminaires are cut-off forward-throw luminaires. The luminaires are arranged relative to each other such that each luminaire, respectively, does not block light originating from any of the other luminaires.

8 Claims, 3 Drawing Sheets

FIG. 1
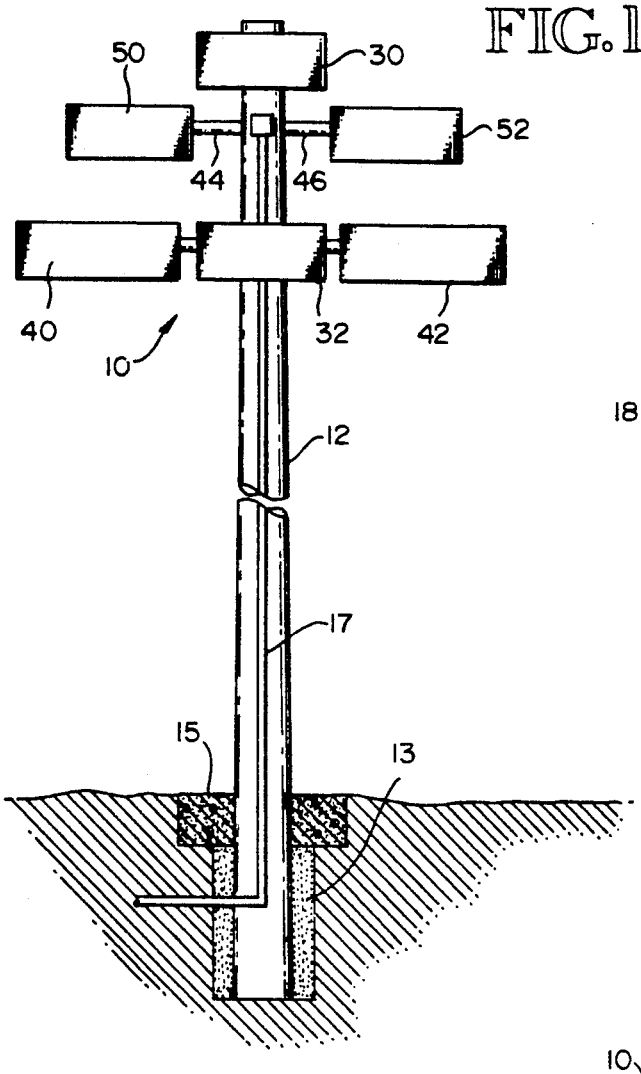
FIG. 3
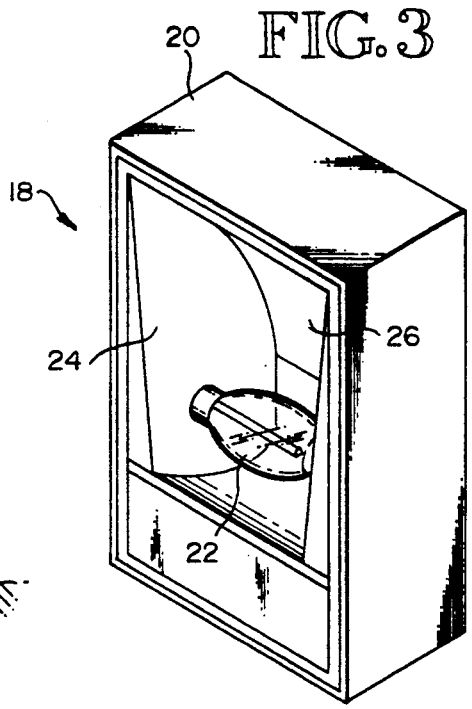
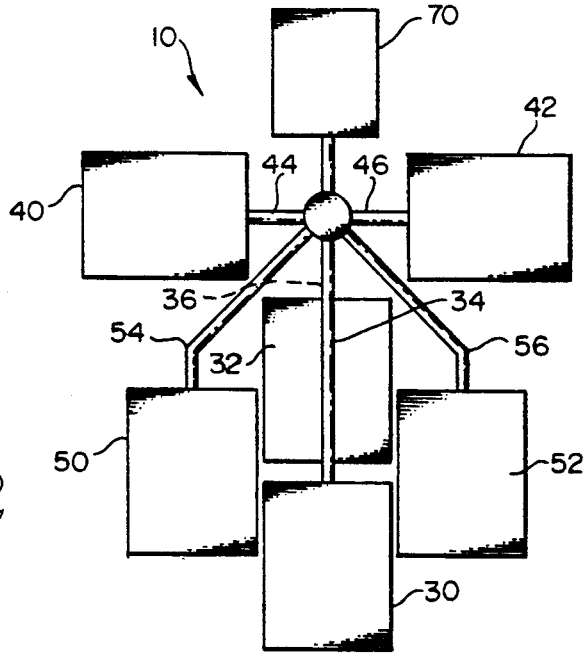
FIG. 2

LIGHTING SYSTEM FOR PLAYING FIELDS

TECHNICAL FIELD

This invention relates generally to the illumination art and more specifically concerns a system for illuminating large outdoor playing fields, such as a soccer or softball field.

BACKGROUND OF THE INVENTION

Conventional sports field illumination, such as for neighborhood soccer fields, softball fields, etc., typically includes several large, tall illumination structures around the field. Each illumination structure includes a 50 to 100-foot concrete, wood or steel pole having a cluster (4 to 24) of conventional floodlights mounted at or near the top of the pole. These illumination structures typically produce a large amount of what is known as "spill light" as well as glare. Spill light is that light which is off the area which is to be lit, while glare is that light which is directed into the sky, producing a "sky glow" in the vicinity of the field. The lights used in the conventional illumination structure, i.e. floodlights, produce rather harsh illumination on the playing surface. Substantial glare is typically present for the players on the field as well as the spectators. While the relatively harsh light and the glare on the field affect the playing conditions, the light directed into the sky is quite unsatisfactory to the neighborhood residents. Accordingly, the installation of illuminated fields in residential neighborhoods is often discouraged, if not actively opposed, even though the demand for recreational playing fields is quite high.

Although the disadvantages of conventional illumination systems for playing fields are known, this field of illumination design has been characterized generally by rather slow, gradual innovation since the introduction of large-scale floodlight systems.

DISCLOSURE OF THE INVENTION

Accordingly, the present invention is a lighting system for illuminating large outdoor playing fields which comprises a plurality of illumination assemblies, which are arranged around the field at selected points, at least one illumination assembly being positioned on each longitudinal side of the field, wherein the illumination assembly includes a support pole and a plurality of luminaires, with the luminaires having a cut-off forward-throw light distribution characteristic and characterized by substantially all the light which is emitted therefrom being below the horizontal plane thereof, the illumination assembly further including a mounting arm for each luminaire, permitting the positioning of each luminaire uniquely in space relative to the other luminaires, wherein the mounting arms are so arranged and having differing lengths that the luminaires mounted thereon, respectively, are so positioned in space that any one luminaire does not block light directed from any other luminaire in the illumination assembly to the playing field.

BRIEF DESCRIPTION OF THE DRAWINGS

FIG. 1 is a front elevation view of an illumination structure of the present invention.

FIG. 2 is a top plan view of the illumination structure of FIG. 1.

FIG. 3 is a schematic view of a single luminaire useful in the apparatus of the present invention.

BEST MODE FOR CARRYINT OUT THE INVENTION

Figure 6:
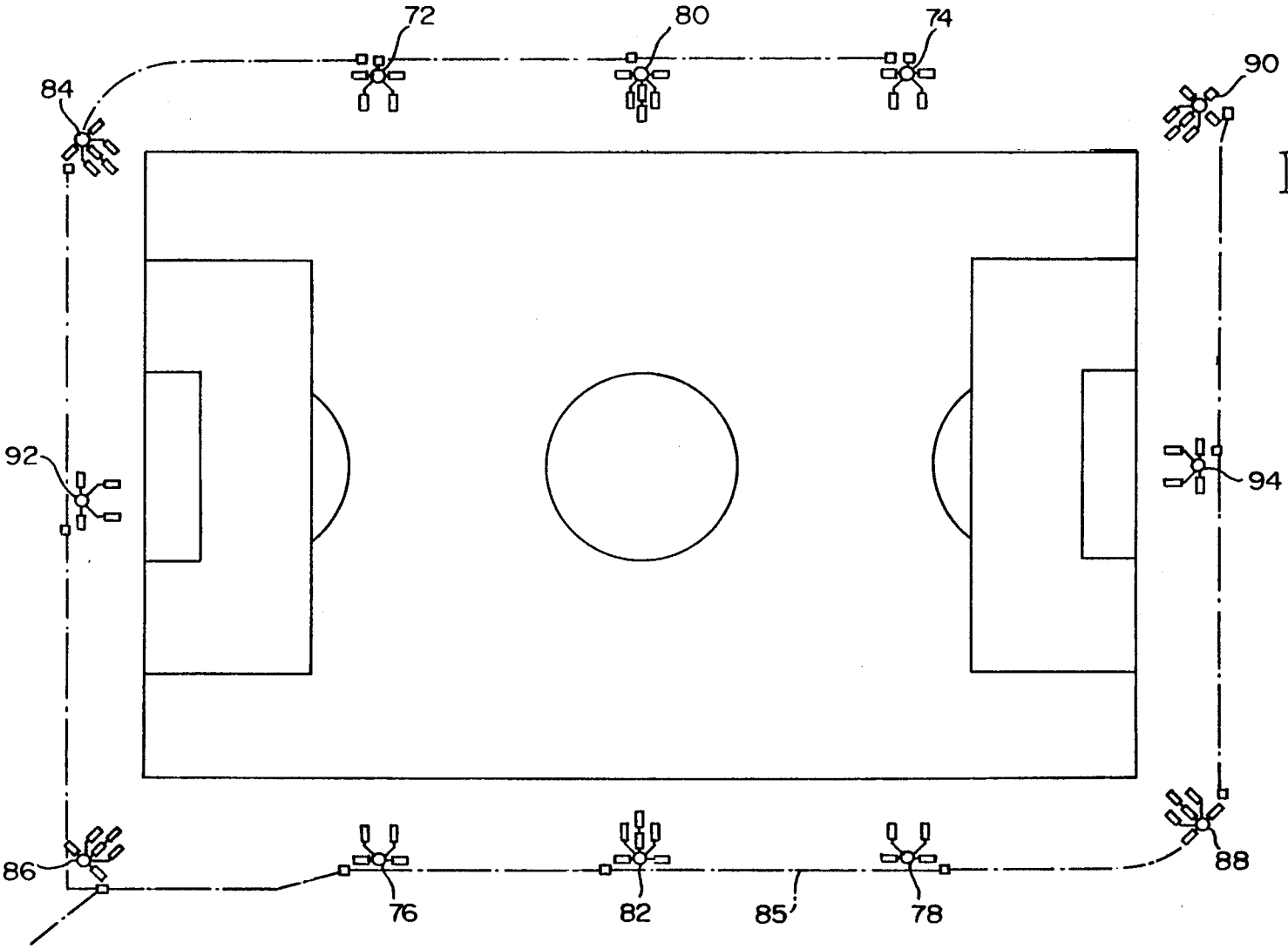
FIG. 6 is a top plan view showing a complete playing field illumination system, incorporating a plurality of illumination structures.

Referring briefly to FIG. 6, the present invention is a system for illuminating large outdoor playing fields, such as a soccer or softball field. The invention includes a plurality of illumination structures which are arranged at selected positions around the field. One such illumination structure is shown in FIGS. 1 and 2. The illumination structure, referred to generally at 10, includes a mounting pole 12, a plurality of individual light sources, referred to herein as luminaires, and a plurality of mounting arms, which extend from mounting pole 12 and to which the luminaires are mounted. The mounting arms are typically metal pipe or the like, approximately 2½ to 3 inches in diameter.

The mounting pole 12 may be made of various materials, including concrete, wood or steel, and may be various heights, but typically is between 65 feet to 80 feet above the ground. The mounting pole is anchored conventionally in the ground, typically approximately 10 feet to 12 feet deep, with crushed rock 13 surrounding the periphery of the pole near the lower end thereof. The ground 15 adjacent pole 12 is typically sloped away from the pole to provide drainage, and a handhole (not shown) is usually located close to the base of the pole 12 for access to electrical connections between an underground power cable and the pole electrical line 17, which extends from the handhole to the pole and then up the pole to the luminaires, in conventional fashion.

The luminaires typically use high power (1000 watt), high intensity lamps such as metal halide. A luminaire useful in the apparatus of the present invention is shown in FIG. 3. Typically, luminaire 18 will include a housing 20, a lamp 22, a lens 24 through which the light from the lamp is directed, and a reflector 26, among other elements. The specific luminaire used in the apparatus of the present invention is referred to generically as a cut-off forward throw luminaire. Such a luminaire directs light downwardly and forwardly and has particular distribution characteristics which are useful in the present invention. Relatively little, if any, light is directed above the horizontal plane of the luminaire. A suitable forward throw luminaire is available from Sterner Lighting Systems, Inc. Forward-throw luminaires available from other manufacturers can be readily modified to provide suitable illumination characteristics.

These forward-throw luminaires come in various wattage ratings, but a 1000-watt luminaire is known to be useful in the present invention. The dimensions of a 1000-watt luminaire, for example, will typically be 31 inches long by 24 inches wide by 10 inches deep. The luminaire itself is not described in further detail, since it is commercially available and known in the field of illumination system design.

The luminaires are mounted on the mounting pole 12 in particular patterns. One pattern is shown in FIGS. 1 and 2. This arrangement includes a total of six luminaires. Luminaires 30 and 32 in the structure of FIGS. 1 and 2 extend directly to the front of the illumination structure 10, with the top most luminaire 30 mounted at the end of a mounting arm 34 which is 44 inches long and located approximately 12 inches from the top of pole 12. Luminaire 32 is mounted at the end of a mounting arm 36 which is located approximately 44 inches directly below mounting arm 34, and is approximately 10 inches long. Luminaires 40 and 42 are positioned at 90 degrees to luminaires 30 and 32, extending to the opposite sides of the illumination structure. Luminaire 40 is mounted at the end of arm 44 which is approximately 10 inches long, while luminaire 42 is mounted at the end of arm 46 which is also approximately 10 inches long. Luminaires 40 and 42 are in the same horizontal plane as luminaire 32. The optical systems in luminaires 40 and 42 must be rotated 90° to direct the light forwardly and in the same direction as for the remainder of the luminaires.

Two additional luminaires 50 and 52 are mounted at the ends of arms 54 and 56, respectively. Mounting arm 54 extends outwardly from the pole 12 at an angle of 45 degrees, i.e. midway, between mounting arms 34 and 44. Arm 54 extends for approximately 30 inches, at which point it angles to the front, parallel with arms 34 and 36, for a distance of approximately 6 inches. Arm 54 is located approximately 14 inches below arm 34 and approximately 26 inches below the top of mounting pole 12, in the embodiment of FIGS. 1 and 2. Luminaire 50 thus fits in the open space, both vertically and horizontally, between luminaires 30 and 40. Arm 56, supporting luminaire 52, is on the opposite side of pole 12, between luminaires 30 and 42, a mirror image of the arrangement of luminaire 50 and arm 54.

Figure 4:
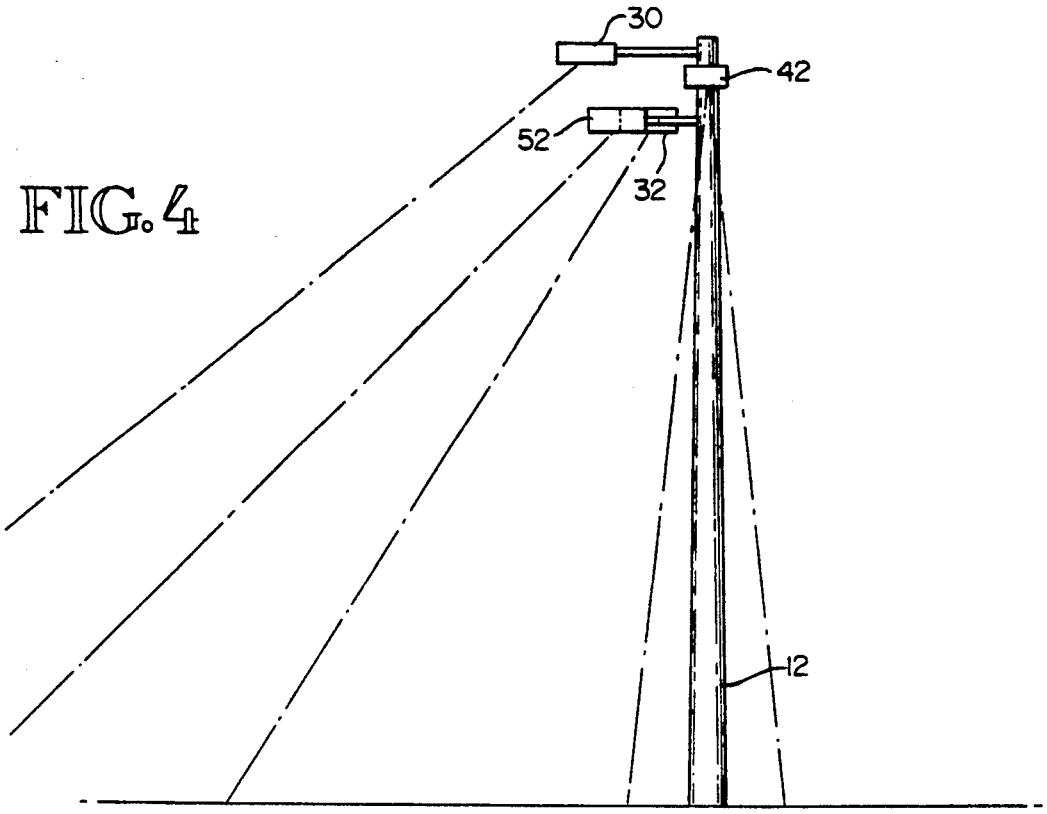
FIG. 4 is a side elevation view of a single illumination structure showing its pattern of light onto a playing field.

The above arrangement, with its variously positioned and configured mounting arms, is such that each luminaire, respectively, does not cut off light from any of the other luminaires in three-dimensional space. Positioning of the luminaires by the described mounting arms at the various spaced locations around the pole makes this result possible. In addition, the use of cut-off forward-throw distribution luminaires, in combination with the particular mounting arrangement, reduces significantly any spill light effect, and results in little, if any, light being directed into the sky, thereby significantly reducing the "sky glow" effect. FIG. 4 shows the forward-throw lighting pattern on a playing field for the luminaire arrangement of the present invention. The "aiming" of the luminaires depends upon setback distance of the illumination structure from the playing field and mounting height.

As indicated above, the lamps in the luminaires could be any high-intensity lamps, but typically will be metal halide and/or high pressure sodium. These lamps produce different lighting effects. In the embodiment shown, metal halide and high pressure sodium lamps are mixed in a single illumination structure, so that a structure with six luminaires, for instance, will have several metal halide lamps with the remainder high pressure sodium. Typically, in the preferred embodiment of the system of the present invention, the mix of the lamps on a single illumination structure is substantially equal, i.e. 50 percent of each type, although this could be varied. This mixing of the lamps produces a pleasing light effect, with low glare and a generally warm, soft light effect, particularly compared with conventional floodlight systems.

Figure 5:
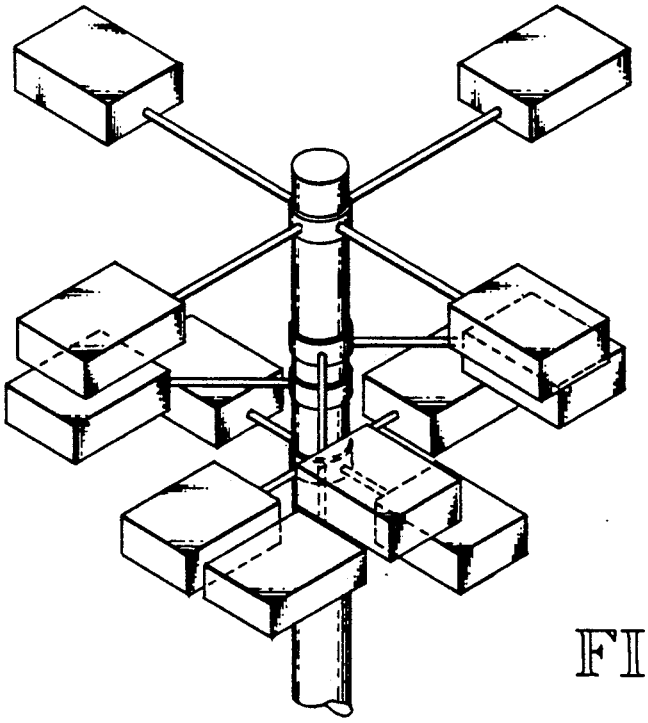
FIG. 5 is a schematic view of an illumination structure showing a variation of the apparatus of FIGS. 1 and 2, with a different number of luminaires.

The present invention contemplates a number of alternative luminaire arrangements. In one variation, referring to FIGS. 1 and 2, luminaires 30 and 32 could be eliminated, resulting in a four-luminaire embodiment. FIG. 5 shows a significantly different luminaire arrangement, with a different number of luminaires and a different positional pattern. The arrangement can vary depending upon the particular application. FIG. 5 shows a total of 12 luminaires. This pattern basically includes four luminaires at 90° intervals spaced relatively close to the pole on a lower level, four additional luminaires spaced at similar 90° intervals, but significantly more outboard than the first four luminaires and a distance above the first four luminaires, and two intermediate pairs of luminaires positioned on two intermediate levels between the first two groups of luminaires, with two luminaires (one from each pair) spaced 180° apart on opposing mounting arms and mounted at an angle thereto, and the other two luminaires being offset from each other and mounted on arms which are in the same vertical plane, spaced a small vertical distance apart. Other arrangements, typically including between four and 12 luminaires, are of course possible, depending upon the particular application. With a larger number of luminaires, an illumination structure could be used to illuminate portions of two adjacent playing fields.

In the present invention, the luminaires are positioned within seven feet of the support pole.

An additional luminaire is shown FIGS. 1 and 2 but is not discussed above. This additional luminaire 70 extends to the rear of the illumination structure and is adapted to provide security lighting for the periphery of the playing field. The security luminaire 70 need not be on every illumination structure, but can be used on as many as appropriate.

Referring now to FIG. 6, a complete system for lighting a sports field is shown. In this arrangement, three illumination structures are used on opposite longitudinal sides of the field, with the structures being set back approximately 15-25 feet from the edge of the playing field. In the embodiment shown, the illumination structures are positioned at the midway and quarter points along the longitudinal length of the field. Outboard (from the center) luminaire structures 72 and 74 along one longitudinal side and illumination structures 76 and 78 on the other longitudinal side use a total of four luminaires each, with the lamps (metal halide/high pressure sodium) in one illumination structure, e.g. 76 on each longitudinal side, respectively, of the field being a mirror image of the other illumination structure, e.g. 78. Illumination structure 72 includes a security luminaire. Center illumination structures 80 and 82 on the two longitudinal sides have six luminaires each and are configured like the structure of FIGS. 1 and 2. The illumination system further includes illumination structures 84, 86, 88 and 90, at the corners of the field, each with a total of six luminaires, and illumination structures 92 and 94 positioned at field-end mid-points, with four luminaires each. If two fields are placed end-to-end, the illumination structures directly between the two fields can be used to illuminate both fields, with double the number of luminaires on each structure. An electrical conduit 85 provides power to all of the illumination structures in the system.

The above-described system has significant advantages over existing playing field illumination systems using banks of conventional floodlights. First, as indicated briefly above, the off-site glare from the illumination system is significantly reduced relative to conventional systems. Since there is little, if any, light which is emitted above the horizontal plane of the luminaire, with the light instead being directed forwardly and downwardly toward the playing field, the undesirable "sky glow" effect is significantly reduced. Not only is there very little illumination above the horizontal plane of the luminaire, the quantity and intensity of illumination for several degrees below the horizontal plane is much less than from conventional systems.

Second, the glare from the illumination system on the field is significantly reduced relative to conventional systems. This occurs because of the arrangement of the luminaires on the poles, as well as the relatively small number of individual luminaires. Although the glare is reduced, the quality of the illumination on the field is better than with a conventional system. The present system, using forward-throw distribution luminaires, moreover, is an efficient system which will not increase operating expense over conventional systems, even with all the advantages discussed herein. As mentioned above, the illumination produced by the present invention also is softer and warmer, due to the mix of metal halide and high pressure sodium lights on each illumination structure.

Hence, the present invention provides improved illumination on a playing field while significantly reducing the adverse illumination impact on the neighborhood. Although a preferred embodiment of the invention has been disclosed herein for purpose of illustration, it should be understood that various changes, modifications, and substitutions may be made without departing from the spirit of the invention, which is defined by the claims which follow:

What is claimed is:

1. A lighting system for illuminating large outdoor playing fields with minimal glare, comprising:

a plurality of illumination assemblies, arranged around a playing field at selected points, with at least one illumination assembly being positioned on each longitudinal side of the playing field, wherein the illumination assembly includes a support pole and a plurality of luminaires, with each luminaire having a cut-off forward-throw light distribution and being fixedly horizontally mounted in a selected horizontal plane so that substantially all the light emitted therefrom is directed downwardly, below the selected horizontal plane thereof, the illumination assembly further including a mounting arm for each luminaire, permitting the fixed positioning of each luminaire uniquely in space relative to the other luminaires, wherein the mounting arms are so arranged and have differing lengths that the luminaires mounted thereon, respectively, are so positioned in space that any one luminaire does not block light directed from any other luminaire in the illumination assembly to the playing field.

2. A lighting system of claim 1, wherein some of the plurality of luminaires in each illumination assembly include a high-pressure sodium light source, and wherein other luminaires in each illumination assembly include a metal halide light source, creating a combined illumination effect on the playing field which is relatively warm and pleasant compared to the illumination effect produced by conventional floodlight systems.

3. A lighting system of claim 1, wherein each illumination assembly includes between four and twelve luminaires.

4. A lighting system of claim 1, wherein the system includes at least three illumination assemblies spaced along each longitudinal side of the playing field, at least one illumination assembly in the vicinity of each corner of the playing field, and one illumination assembly along each end side of the playing field, approximately at a center point of each said end side.

5. A lighting system of claim 1, wherein the luminaires are positioned on at least three different vertical levels along the support pole, within a vertical distance of approximately four feet.

6. A lighting system of claim 5, wherein the luminaires are positioned within seven feet of the support pole.

7. A lighting system of claim 1, wherein each luminaire is individually mounted to the support pole on separate, spaced mounting arms.

8. A lighting system of claim 1, wherein the light from each luminaire is directed through a lens in a lower surface thereof, wherein mounting height of the luminaires and setback of the illumination assembly determine direction of light from the luminaires.

* * * * *